United States Patent [19]

Koning

[11] Patent Number: 4,947,736

[45] Date of Patent: Aug. 14, 1990

[54] CHIMNEY CAP UNIT FOR EXTINGUISHING A STARTING CHIMNEY FIRE

[76] Inventor: Wiebe Koning, Veneweg 172, 7946 LM Wanneperveen, Netherlands

[21] Appl. No.: 363,776

[22] Filed: Jun. 9, 1989

[51] Int. Cl.[5] ..... F23L 11/00

[52] U.S. Cl. ..... 98/86; 169/49; 169/57

[58] Field of Search ..... 98/58, 59, 60, 86, 1; 126/287.5; 169/49, 57, 65

[56] References Cited

U.S. PATENT DOCUMENTS 1,063,068 5/1913 Rose ..... 98/86

4,519,301 5/1985 Wetzel ..... 98/86 X

FOREIGN PATENT DOCUMENTS 544465 9/1922 France ..... 126/287.5

*Primary Examiner*—Harold Joyce

*Attorney, Agent, or Firm*—Watson, Cole, Grindle & Watson

[57] ABSTRACT

Chimney cap unit for extinguishing a starting chimney fire, comprising a part which greatly but not completely restricts the draught during the fire in the flue, and a part which regulates the outflow of the remaining flue gas stream through the normal flue, in such a way that after a chimney fire the throughflow aperture is partially restored, so that no counterflow, which could result in flue gases entering the living-room, can occur in the flue.

2 Claims, 3 Drawing Sheets

Fig.2
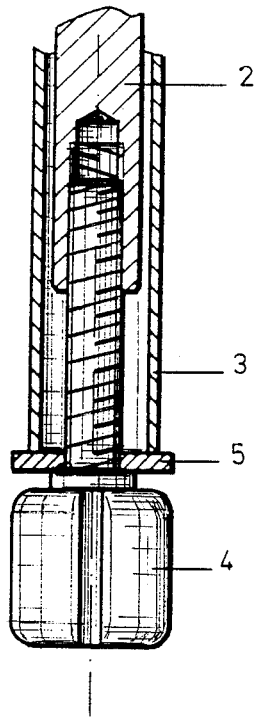
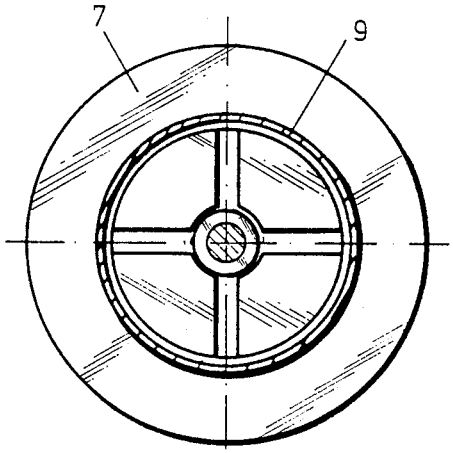
Fig.3
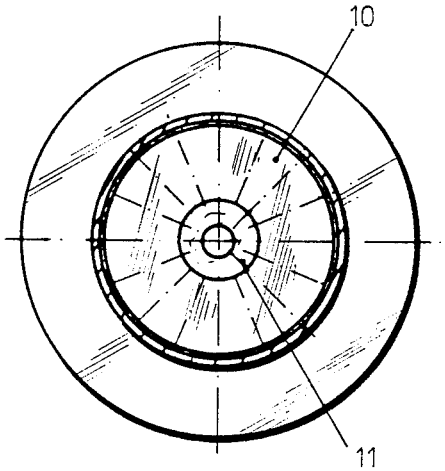
Fig.4

CHIMNEY CAP UNIT FOR EXTINGUISHING A STARTING CHIMNEY FIRE

The present invention relates to a chimney cap unit for extinguishing a starting chimney fire provided with closing means which under normal conditions are kept in an open position by means of a fuse or the like exposed to the flue gases and which in case of a chimney fire move to a more or less closed position.

Such a unit is known from U.S. Pat. No. 4,646,847. In this case the valve means consist of a plate pivotable around a horizontal axis. Under normal conditions said plate is in a vertical position but is nevertheless exposed to the polluting flue gases. Thus, it is not sure that the valve means will operate if after a long time there is a chimney fire.

Further in case of a chimney fire the passage for the flue gase is completely blocked.

Owing to the asymmetric shape of the plate the valve means will open again if owing to the high flue gas temperature below the plate the pressure will increase.

Owing to the restricted opening of the valve means the pressure below the plate will decrease and the plate will close again completely. This process will continue several times.

If the chimney fire is extinguished by smothering the flue gas temperature below the plate will again decrease. Finally the plate will not further open by insufficient pressure below the plate. Thus, the end position is a completely closed valve means, so that discharge of flue gas is not possible and flue gas may enter the living room or the like.

The invention aims to avoid the drawbacks of the known unit and this is obtained in that the valve means under normal conditions are completely outside of the flow of the flue gases and in case of a chimney fire may close the passage for the flue gases except for a restricted opening.

The unit is designed so that it shuts off the flue at the start of a chimney fire, in such a way that the seat of the fire is extinguished or greatly checked, while a slight positive draught always remains in the flue, so that during and after the smothering process no flue gases can enter the living-room from the flue.

Preferably the restricted opening consists of a fixed part and a controllable part the passage of which is controlled by the temperature of the flue gases.

Thus, the flue gas temperature is continuously sensed, on basis of which the variable passage is controlled.

From French Patent Specification 1,008,766 a unit is known whereby the valve means under normal conditions are neither exposed to the flue gases. However, in case of a chimney fire the passage for the flue gases will be completely blocked.

All this is explained with reference to the appended drawings.

FIG. 2 shows a cross section of the lower part of the unit in the centre of the flue;

FIG. 3 shows a cross section of the valve 7 along the line II—III of FIG. 1.

FIG. 4 shows a top view of the unit in the direction of the arrow A;

Figure 1:
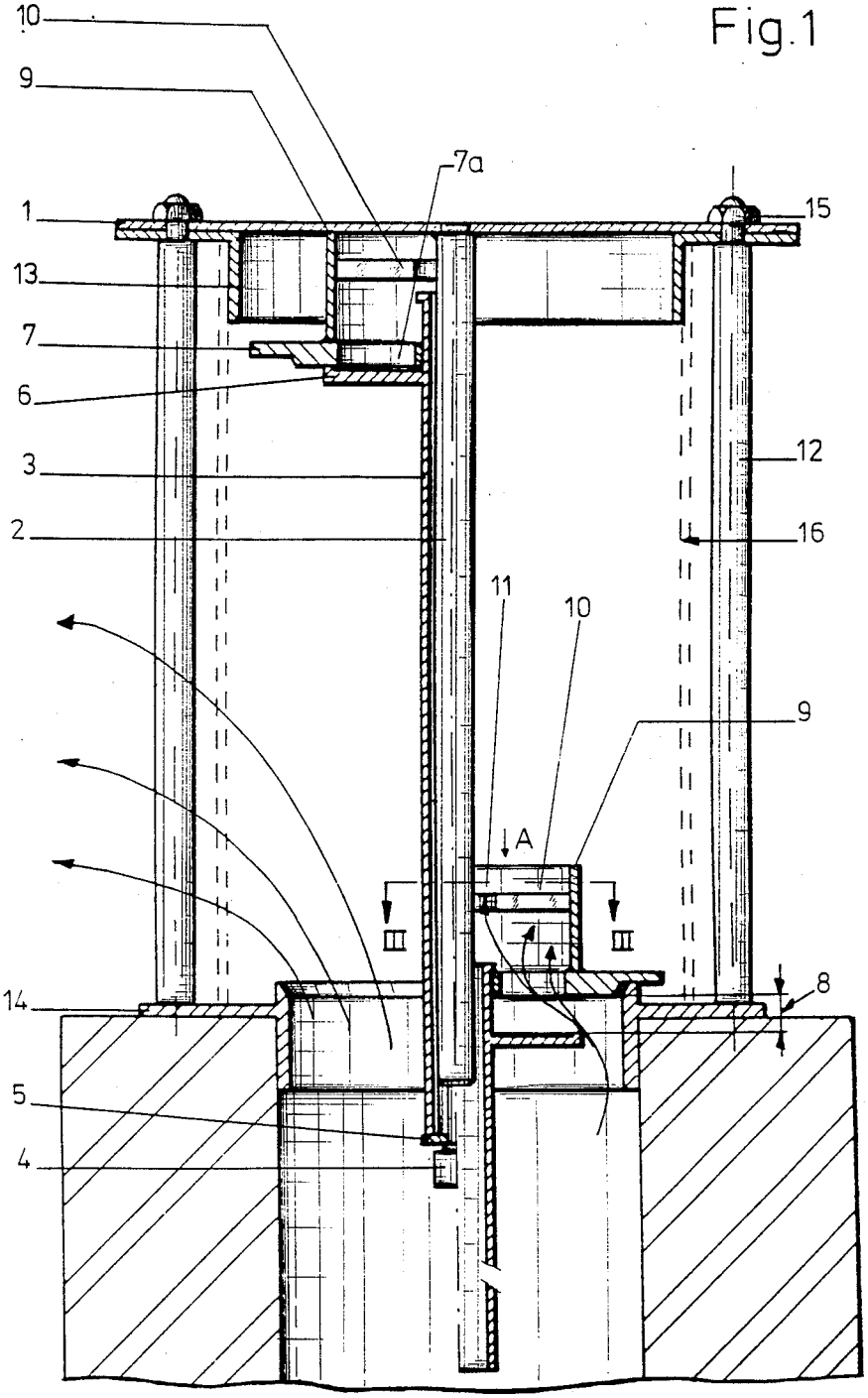
FIG. 1 shows on the left side of the centre line of the flue the cross section of the unit in the normal starting position, the right part showing the situation after it has gone into action.

The unit according to the invention comprises a cap 1 with a central guide rod 2 connected thereto. A pipe 3 can move around this guide rod 2, but in the rest position said pipe is held by a test head (fuse) 4 by means of a supporting disc 5, in that the test head being fixed in the central guide rod 2. An auxiliary valve 6 is fixed to pipe 3 near the top of said pipe. A valve 7, which is centred around pipe 3 by means of spokes *7a*, rests on said auxiliary valve 6. In the normal state the valve 7 rests on the auxiliary valve 6. When the device goes into action a predetermined gap 8 arises between auxiliary valve 6 and valve 7. A cylindrical sleeve 9 is fixed on said valve 7. A temperature-dependent (for example, diaphragm-type) valve 10 is fitted on the top of sleeve 9. It can be controlled by, for example, a bimetal in such a way that below a specific temperature the passage is fully opened, and above that is closed. In the closed position a predetermined aperture 11 is maintained (FIG. 4). In the normal position, in which the test head 4 retains the whole unit, the cylindrical sleeve 9 is pressed at the top against the inside of cap 1 by means of pipe 3, auxiliary valve 6 and valve 7. The cap 1 and flange 13 are fixed on the ring 14 with a number of distance bolts 12. The ring 14 is connected to the mouth of the flue. When the nuts 15 are loosened the entire internal parts can be removed for checking or for periodic cleaning o the flue. The adjustment then remains completely intact. Number 16 symbolizes a spark arrester.

The whole unit acording to FIGS. 1, 2 and 3 works as follows. After overheating of the test head 4, which is situated in the flue gases, disc 5 will no longer be supported, and therewith pipe 3, with auxiliary valve 6 attached thereto, and valve 7—to which sleeve 9 and the temperature-dependent valve 10 are connected—will also move downwards. The valve 7 in the end hits the top edge (seat of valve 7) of ring 14 with force. The auxiliary valve 6 continues over a distance 8, thus forming an aperture between auxiliary valve 6 and valve 7. The situation which has thus arisen is shown in the righthand part of FIG. 1. The above-mentioned aperture brings about a first arresting of the seat of the fire. Through this aperture, the flue gases are able to pass out through open valve 10 and aperture 11. Due to the still high temperature of the flue gases, the temperature-dependent valve 10 is heated and will close as it expands.

The chimney draught is further reduced, because only aperture 11 is available after the valve is closed. Due to the small aperture and the flue gas flow being thereby delayed, the oxygen (air) supply to the seat of the fire will also decrease, so that the fire is smothered. The temperature will now drop, as a result of which valve 10 will be opened again. Due to the contraction of valve 10, the effective area of aperture 11 will increase. This means that a positive draught will always be present in the flue, and no dangerous flue gases will be able to penetrate into the living-room.

Figure 5:
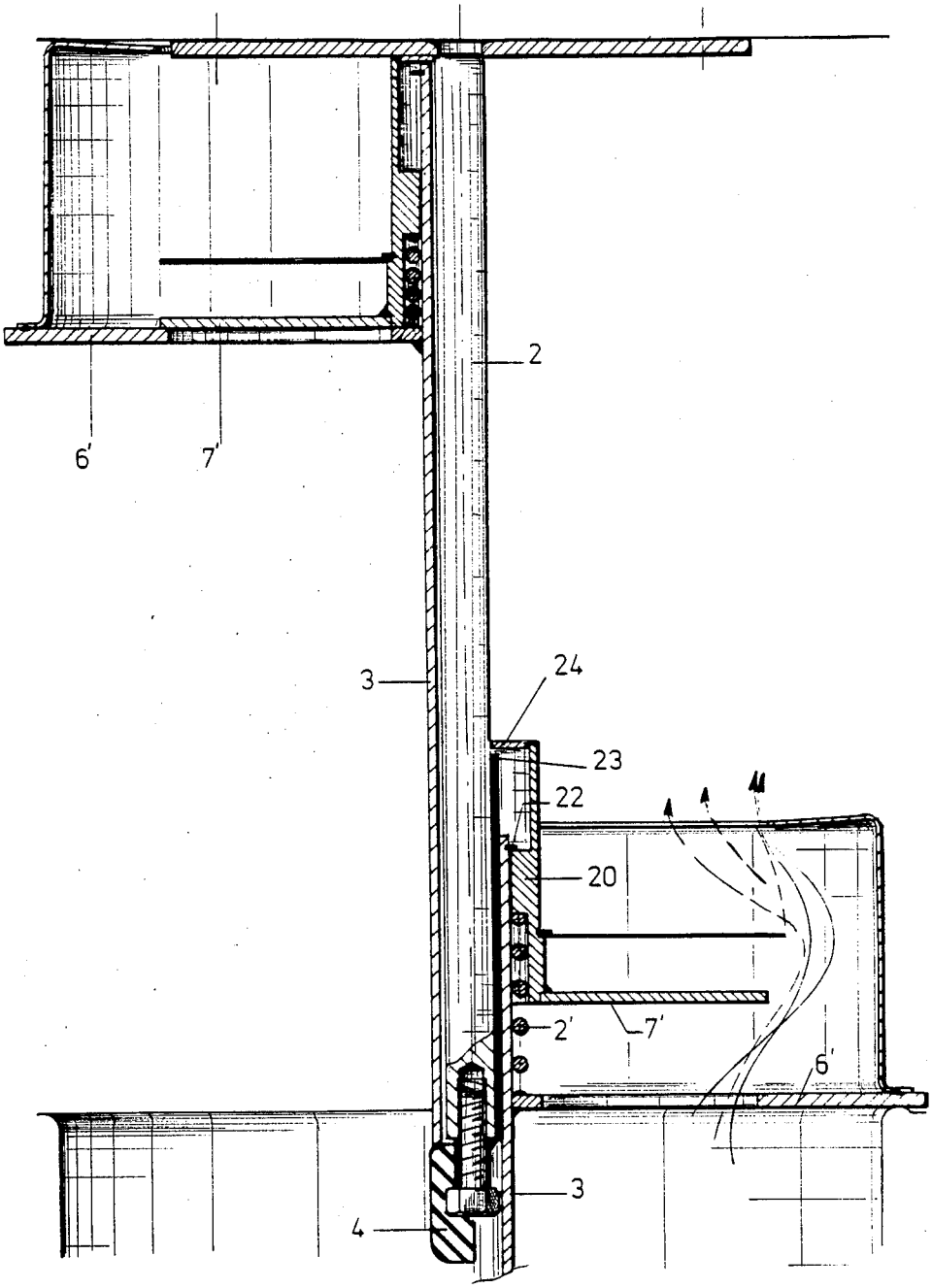
FIG. 5 shows a modified embodiment of FIG. 1.

In FIG. 5 a modified embodiment is shown, whereby again the left part is a cross-section in the normal starting position and the right part is a cross-section showing the situation after it has gone into action.

Here also a test head 4, a guide rod 2 and a pipe 3 are used. Further, the auxiliary valve, indicated with 6' is fixed to the pipe 3. The other valve is indicated with 7'.

According to this embodiment the auxiliary valve 6' is moving downwards with respect to the valve 7', see the right side of FIG. 5.

In this way it is prevented that a strongly pollluted flue shall be closed by said auxiliary valve 6'. Further it is prevented that when the auxiliary valve 6' is not opened, for instance at very short pollution, there could occur a complete closing of the flue.

The valve 7' is fixed to a bushing 20 which is slidable along the pipe 3, whereby a pressure spring 21 is acting between the auxiliary valve 6' and an abutment 22 on the upper end of the pipe 3.

Between the guide rod 2 and the pipe 3 a key shaped member 23 is present around which the pipe 3 normally can move.

The bushing 20 is provided with an abutment ring 24.

If the unit comes into operation and the valves 6' and 7' are not separated owing to strong pollution the abutment ring 24 will abut the key shaped member 23, so that valve 7' will remain at a sufficient distance from the channel mouth. After some time of super heating of valves 6' and 7' by the hot flue gases the separation will as yet occur.

The flue gases are flowing through the unit according to the arrows B in FIG. 5.

With 25 a flue gas defecting plate is indicated.

I claim:

1. Chimney cap unit including a chimney cap for extinguishing a starting chimney fire comprising:

means for closing the passage during the chimney fire except for a restricted opening having first and second portions, said closing means being outside the flow of flue gases during normal operating conditions with no fire; and means for controlling the passage of the flue gases through the first portion of the restricted opening in response to the temperature of the flue gases.

2. The chimney cap unit according to claim 1, further comprising means for removing said closing means and controlling means from the chimney cap such that said closing means and controlling means remain in the same position relative to one another.

* * * * *